US006725867B2

(12) United States Patent
Peterson et al.

(10) Patent No.: US 6,725,867 B2
(45) Date of Patent: Apr. 27, 2004

(54) PROCESS FOR PRODUCING SMOKING ARTICLES WITH REDUCED IGNITION PROCLIVITY CHARACTERISTICS AND PRODUCTS MADE ACCORDING TO SAME

(75) Inventors: Richard M. Peterson, Marietta, GA (US); Joseph S. Kucherovsky, Philadelphia, PA (US); Thomas A. Kraker, Alpharetta, GA (US)

(73) Assignee: Schweitzer-Mauduit International, Inc., Alpharetta, GA (US)

( * ) Notice: Subject to any disclaimer, the term of this patent is extended or adjusted under 35 U.S.C. 154(b) by 0 days.

(21) Appl. No.: 10/054,744

(22) Filed: Nov. 13, 2001

(65) Prior Publication Data

US 2002/0139381 A1 Oct. 3, 2002

Related U.S. Application Data

(60) Provisional application No. 60/248,061, filed on Nov. 13, 2000.

(51) Int. Cl.[7] ..... A24D 01/02; A24C 01/42

(52) U.S. Cl. ..... 131/365; 131/360; 131/349; 131/347; 131/284; 162/139

(58) Field of Search ..... 131/365, 360, 131/349, 347, 284; 162/139

(56) References Cited

U.S. PATENT DOCUMENTS

| | | | |
|---|---|---|---|
| 1,996,002 | A | 3/1935 | Seaman |
| 2,013,508 | A | 9/1935 | Bergman |
| 2,776,912 | A | 1/1957 | Gregory |
| 3,215,579 | A | 11/1965 | Hagen |
| 3,511,247 | A | 5/1970 | Tamol |
| 3,526,904 | A | 9/1970 | Tamol |
| 3,699,973 | A | 10/1972 | Tamol, et al. |
| 3,736,940 | A | 6/1973 | Saint-Pastou |
| 3,911,932 | A | 10/1975 | Houck, Jr., et al. |
| 3,949,762 | A | 4/1976 | West et al. |
| 4,077,414 | A | 3/1978 | Baker et al. |
| 4,129,134 | A | 12/1978 | Hind et al. |

(List continued on next page.)

FOREIGN PATENT DOCUMENTS

| | | |
|---|---|---|
| EP | 0193607 B1 | 1/1989 |
| EP | 0386884 A2 | 9/1990 |
| GB | 848332 | 8/1956 |

OTHER PUBLICATIONS

Pulp and Paper Chemistry and Chemical Technology Third Edition Volume III by James P. Casey—Editor—A Wiley–Interscience Publication—pp 1507–1521 & pp 1702–1703.

*Primary Examiner*—Dionne A. Walls
(74) *Attorney, Agent, or Firm*—Dority & Manning, P.A.

(57) ABSTRACT

A process for reducing the permeability of a paper wrapper used in the construction of a smoking article is disclosed. The paper wrapper is treated with a film-forming composition that forms treated discrete areas on the wrapper. The treated discrete areas have a permeability within a predetermined range sufficient to reduce the ignition proclivity properties of a smoking article made with the wrapper. In accordance with the present invention, the film-forming composition is applied as multiple layers to the paper wrapper. After each application step, the wrapper is dried. Applying the film-forming composition to the paper wrapper in multiple layers minimizes distortion and other adverse affects that may occur to the wrapper.

46 Claims, 3 Drawing Sheets

U.S. PATENT DOCUMENTS 4,146,040 A 3/1979 Cohn
4,222,740 A 9/1980 Bohrn et al.
4,267,240 A 5/1981 Jaisle et al.
4,303,084 A 12/1981 Simon
4,452,259 A 6/1984 Norman et al.
4,590,955 A 5/1986 Dixit
4,607,647 A 8/1986 Dashley et al.
4,615,345 A 10/1986 Durocher
4,622,983 A 11/1986 Mathews et al.
4,679,575 A 7/1987 Yamaguchi et al.
4,739,775 A 4/1988 Hampl, Jr.
4,805,644 A 2/1989 Hampl, Jr.
4,889,145 A * 12/1989 Adams et al. ..... 131/365
4,984,589 A 1/1991 Riedesser
4,998,542 A 3/1991 Kallianos et al.
5,057,606 A 10/1991 Garbe
5,092,353 A 3/1992 Montoya et al.
5,131,416 A 7/1992 Gentry
5,144,966 A 9/1992 Washington
5,170,807 A 12/1992 Kasbo et al.
5,178,167 A 1/1993 Riggs et al.
5,221,502 A 6/1993 Washington
5,261,425 A 11/1993 Raker et al.
5,263,999 A 11/1993 Baldwin et al.
5,271,419 A 12/1993 Arzonico et al.
5,417,228 A 5/1995 Baldwin et al.
5,540,242 A 7/1996 Chao et al.
5,690,787 A 11/1997 Hultman et al.
5,722,433 A 3/1998 Ishino et al.
5,820,998 A 10/1998 Hotaling et al.
5,849,153 A 12/1998 Ishino et al.
5,878,753 A * 3/1999 Peterson et al. ..... 131/365
5,878,754 A 3/1999 Peterson et al.

* cited by examiner

PROCESS FOR PRODUCING SMOKING ARTICLES WITH REDUCED IGNITION PROCLIVITY CHARACTERISTICS AND PRODUCTS MADE ACCORDING TO SAME

RELATED APPLICATION

The present application is based upon a Provisional Application having U.S. patent application Ser. No. 60/248,061, filed on Nov. 13, 2000.

BACKGROUND OF THE INVENTION

There is an ongoing concern in the tobacco industry to produce cigarettes having wrappers which reduce the ignition proclivity of the smoking article, or the tendency of the smoking article to ignite surfaces which come into contact with the lit smoking article. Reports have been made of fires attributed to burning cigarettes coming into contact with combustible materials. A justifiable interest exists in the industry to reduce the tendency of cigarettes, or other smoking articles to ignite surfaces and materials used in furniture, bedding, and the like upon contact.

Thus, a desirable feature of smoking articles, particularly cigarettes, is that they self-extinguish upon being dropped or left in a free burning state on combustible materials.

It has long been recognized in the tobacco industry that the cigarette wrapper has a significant influence on the smolder characteristics of the cigarette. In this regard, various attempts have been made in the art to alter or modify the cigarette wrappers in order to achieve the desired tendency of the cigarette to self-extinguish, or in other words to reduce the ignition proclivity characteristics of cigarettes.

The prior art describes the application of film-forming solutions to cigarette paper to reduce the paper permeability and control the burn rate. It has been shown that when these materials have been applied in discrete areas along the length of the cigarette, the cigarette shows a reduced propensity to ignite a substrate, tends to self-extinguish, and has a higher puff count.

U.S. Pat. No. 5,878,753 to Peterson which is incorporated herein by reference, for example, describes a smoking article wrapper being treated with a film-forming aqueous solution to reduce permeability. U.S. Pat. No. 5,878,754 to Peterson which is also incorporated herein by reference describes a smoking article wrapper being treated with a non-aqueous solution of a solvent soluble polymer dissolved in a non-aqueous solution to reduce permeability.

In some cases, when a solution is applied to the paper wrapper and dried there is a tendency for the paper to experience non-uniform dimensional changes. In particular, applying coatings in the form of bands can cause the bands to shrink relative to the uncoated paper, causing the uncoated areas to bulge out.

Although some improvements have been made in the art, there is still a need for an improved method for producing a cigarette wrapper with reduced ignition proclivity properties. Specifically, a need exists for an improved method of applying a film-forming solution to a paper wrapper in discrete areas for decreasing the permeability of the wrapper without causing non-uniform dimensional changes in the wrapper or otherwise adversely affecting the appearance of the wrapper.

SUMMARY OF THE INVENTION

The present invention is generally directed to paper wrappers for smoking articles with reduced ignition proclivity and to a process for making the wrappers. For example, in one embodiment, the process includes the steps of providing a paper wrapper made from a paper web. For example, the paper wrapper can contain flax fibers, softwood fibers, hardwood fibers and mixtures thereof. The paper wrapper can also include a filler, such as calcium carbonate, in an amount from about 10% to about 40% by weight.

In accordance with the present invention, multiple layers of a film-forming composition are applied to the paper wrapper at particular locations. The multiple layers of the film-forming composition form treated discrete areas on the wrapper. The discrete areas are separated by untreated areas. The treated discrete areas have a permeability within a predetermined range sufficient to reduce ignition proclivity. For example, the treated areas can reduce ignition proclivity by reducing oxygen to a smoldering coal of the smoking article as the coal burns and advances into the treated areas.

In one embodiment of the present invention, the paper wrapper is dried in between application of each layer of the film-forming composition. The paper wrapper can be dried by being contacted with a hot gas stream, by being placed in contact with a steam can, by being with infra-red rays or can simply be air dried.

The film-forming composition can be can be applied to the paper wrapper according to various methods. For example, the multiple layers can be printed onto the paper using, for instance, flexography, direct gravure printing, and offset gravure printing.

In one embodiment, the discrete areas formed by the film-forming composition are in the shape of circumferential bands disposed longitudinally along the smoking article. The bands can have a width of greater than about 4 mm, such as from about 5 mm to about 10 mm. The bands can be spaced from each other at a distance of from about 5 mm to about 30 mm and particularly from about 5 mm to about 20 mm.

The film-forming composition can be made from any suitable material that will provide the desired burn characteristics. Examples of film-forming composition that can be used include alginate solutions, pectin solutions, silicate solutions, starch solutions, carboxymethyl cellulose solutions, other cellulose derivative solutions, guar gum solutions, and mixtures thereof. If desired, the film-forming composition can include a filler, such as chalk, clay, a metal oxide, calcium carbonate, or mixtures thereof.

The amount of the film-forming composition that is applied to the paper wrapper depends upon the particular application and various factors. The amount applied to form each layer of the treated discrete areas can also vary depending upon the particular application. For example, in one embodiment, the film-forming composition can be applied to form a relatively light layer initially. Subsequently, heavier layers of the composition can be formed.

Alternatively, the film-forming composition can initially be applied as a relatively heavy layer. Lighter layers can then be placed on the heavier layer subsequently.

In still another embodiment of the present invention, a paper wrapper having reduced ignition proclivity characteristics is formed from a paper web having a relatively high permeability. For instance, the paper web can have a permeability of greater than about 60 Coresta, such as from about 60 to about 110 Coresta, and more particularly from about 60 to about 90 Coresta. A film-forming composition can then be applied to the paper web to form treated discrete areas with reduced ignition proclivity. The treated discrete areas can be formed from multiple layers of the film-forming composition.

Besides being directed to a process for reducing the permeability of a paper, the present invention is also directed to the paper wrapper itself and to smoking articles made from the paper wrapper. For example, a smoking article can include a tobacco column surrounded by a wrapper. The wrapper can be made from a paper web as described above.

In accordance with the present invention, the paper wrapper can include treated discrete areas separated by untreated areas. The treated discrete areas can be made from a multi-layered film and can have a permeability within a predetermined range sufficient to reduce the ignition proclivity properties of the article. For example, the treated areas can have a permeability of less than about 25 Coresta units, particularly less than 15 Coresta units, and more particularly from about 2 Coresta units to about 10 Coresta units.

The multi-layered film applied to the paper wrapper can be made according to the process described above. The amount of layers used to make the film can vary depending upon the particular application. For most applications, the film will contain at least two layers, and particularly from about three to about eight layers.

Other features and aspects of the present invention are discussed in greater detail below.

BRIEF DESCRIPTION OF THE DRAWINGS

A full and enabling disclosure of the present invention, including the best mode thereof to one of ordinary skill in the art, is set forth more particularly in the remainder of the specification, including reference to the accompanying figures in which.

Figure 1:
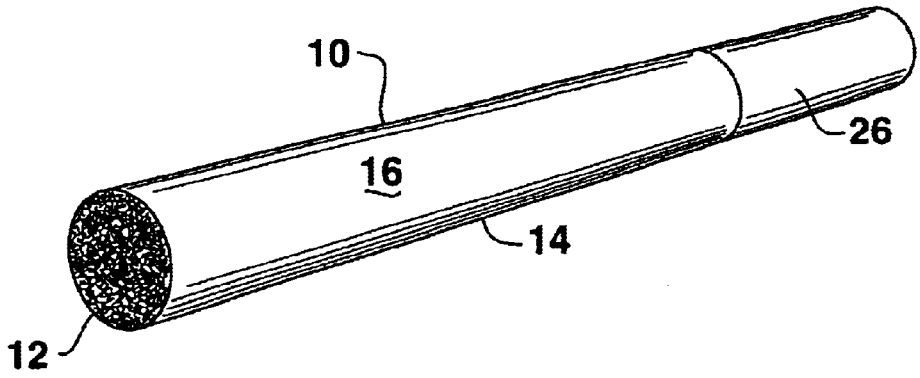
FIG. 1 is a perspective view of a smoking article made in accordance with the present invention.

Repeat use of reference characters in the present specification and drawings is intended to represent same or analogous features or elements of the present invention.

DETAILED DESCRIPTION

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents.

For purposes of explanation of the invention, the embodiments and principles of the invention will be discussed in regards to a cigarette. However, this is for the purposes of explanation of the invention only and is not meant to limit the invention only to cigarettes. Any manner of smoking article is within the scope and spirit of the invention.

The invention relates to a smoking article, and a wrapper for a smoking article, having improved ignition proclivity control characteristics. "Ignition proclivity" is a measure of the tendency of the smoking article or cigarette to ignite a flammable substrate if the burning cigarette is dropped or otherwise left on a flammable substrate. A test for ignition proclivity of a cigarette has been established by NIST (National Institute of Standards and Technology) and is generally referred to as the "Mock-Up Ignition Test". The test comprises placing a smoldering cigarette on a flammable test fabric and recording the tendency of the cigarette to either ignite the test fabric, burn the test fabric beyond a normal char line of the fabric, burn its entire length without igniting the fabric, or self-extinguish before igniting the test fabric or burning its entire length.

Another test for ignition proclivity is referred to as the "Cigarette Extinction Test". In the Cigarette Extinction Test, a lit cigarette is placed on one or more layers of filter paper. If the cigarette self extinguishes, the cigarette passes the test. If the cigarette burns all the way to its end on the filter, however, the cigarette fails. Smoking articles made in accordance with the present invention can be designed to pass one or both of these tests.

In general, smoking articles having reduced ignition proclivity are made according to the present invention by applying in discrete areas to a wrapping paper a composition, such as a film-forming composition, in a multiple pass application process. In particular, the composition is applied to the wrapping paper in successive steps in order to form areas on the paper having reduced ingnition proclivity. In one embodiment of the present invention, the wrapping paper is dried in between each successive step of applying the composition to the paper. By applying the composition in multiple steps and by drying in between each step, it is believed that reduced ignition proclivity areas can be formed on the wrapping paper without causing non-uniform dimensional changes in the paper and without adversely interfering with the appearance of the paper.

In an alternative embodiment of the present invention, the amount of the composition that is applied to the wrapping paper during each successive application of the composition is varied. For instance, in some applications, the composition is first applied to the wrapping paper at relatively high amounts. In successive steps, the amount of the composition applied to the paper is decreased. In other applications, however, the composition is first lightly applied to the wrapping paper. After initial application, heavier amounts of the composition are then applied to the paper. By varying the amount applied to the wrapping paper during each step, areas having reduced ignition proclivity can be formed on the wrapper with controlled properties.

Applying compositions to paper wrappers in multiple application steps also permits the formation of reduced ignition proclivity areas on wrappers having relatively high permeability characteristics, such as on wrappers having a permeability of at least 60 Coresta units. According to the present invention, high porosity paper wrappers having reduced ignition proclivity properties capable of passing both of the Mock-Up Ignition Test and the Cigarette Extinction Test when formed into a smoking article are possible.

Figure 2:
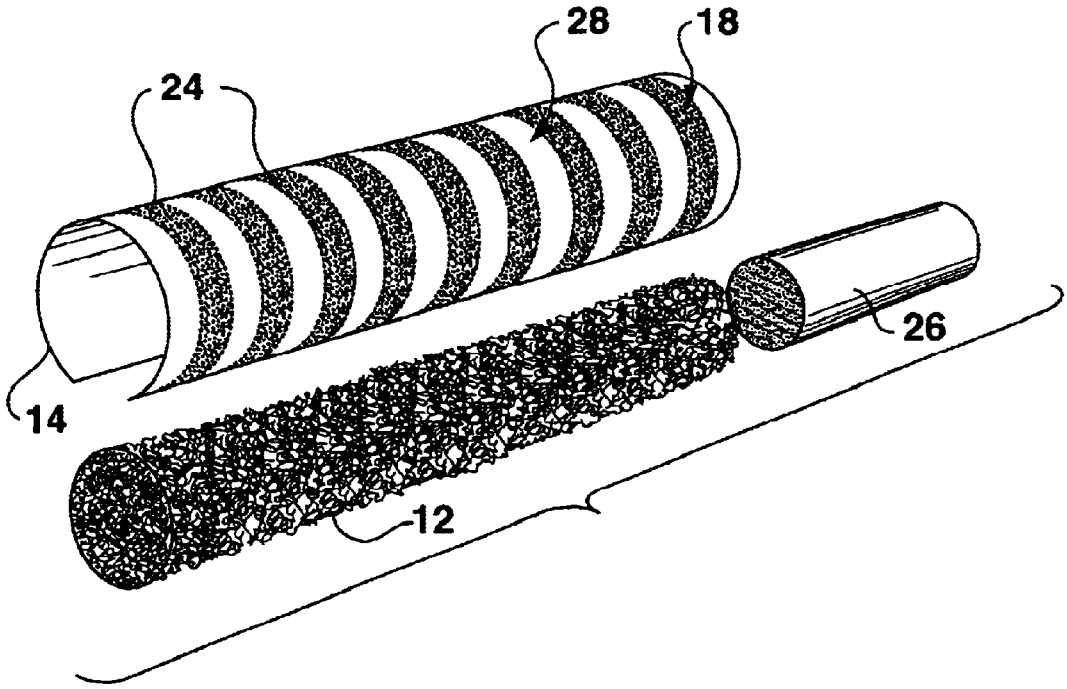
FIG. 2 is an exploded view of the smoking article illustrated in FIG. 1.

In order to assist in describing and explaining the present invention, one embodiment of the invention is illustrated generally in FIGS. 1 and 2. A smoking article (cigarette), generally 10, having improved ignition proclivity characteristics includes a tobacco column 12 within a wrapper 14. Article 10 may include a filter 26. Wrapper 14 may include any manner of commercially available cigarette wrapper.

Generally, the wrapping paper can be made from cellulosic fibers obtained, for instance, from flax, softwood or hardwood. In order to vary the properties of the paper as desired, various mixtures of cellulosic fibers can be used. The extent to which the fibers are refined can also be varied.

For most applications, the paper wrapper will contain a filler. The filler can be, for instance, calcium carbonate, magnesium oxide, or any other suitable material. The total filler loading added to the paper wrapper can be between about 10% to about 40% by weight.

The permeability of a paper wrapper for smoking articles made according to the present invention can generally be from about 10 Coresta units to about 200 Coresta units. In some applications, the permeability can be between about 15 Coresta units to about 55 Coresta units. In one embodiment of the present invention, however, the initial permeability of the paper wrapper is relatively high. For instance, in one embodiment, the permeability of the paper wrapper can be from about 60 Coresta units to about 110 Coresta units, and particularly from about 60 Coresta units to about 90 Coresta units. As described above, the process of the present invention is particularly well suited for use with relatively high permeable paper wrappers if desired for a particular application.

The basis weight of cigarette wrapping paper is usually between about 18 gsm to about 60 gsm, and more particularly between about 15 gsm to about 40 gsm. Wrapping papers according to the present invention can be made within any of these ranges.

The wrapping paper may also be treated with a burn control additive, which may also serve as an ash conditioner. Such burn control additives can include, for instance, alkali metal salts, acetates, phosphate salts or mixtures thereof. A particularly preferred burn control additive is a mixture of potassium citrate and sodium citrate. The burn control additive can be added to the paper in an amount from about 0.3% to about 5% by weight, and more particularly from about 0.3% to about 2.5% by weight.

Paper web 14 defines an outer circumferential surface 16 when wrapped around tobacco column 12. Discrete areas 18 of outer circumferential surface 16 are treated with a composition. Some aqueous compositions that may be used include alginate, pectin, silicate, carboxymethyl cellulose, other cellulose derivatives, guar gum, starch, modified starch, polyvinyl acetate, and polyvinyl alcohol compositions. Beside aqueous compositions, non aqueous compositions can also be used in the present invention. For example, in one embodiment, a cellulosic polymer, such as ethyl cellulose, can be contained in a non aqueous solvent, such as an alcohol, an acetate, or mixtures of both. For example, in one embodiment, ethyl cellulose can be contained in a solvent that is a mixture of isopropyl alcohol and ethyl acetate.

The composition can also include a particulate inorganic non-reactive filler disbursed or suspended in the composition, as discussed more fully below. It should also be understood that treated areas 18 could also be disposed on the inner surface of wrapper 14. In other words, wrapper 14 could be rolled around tobacco column 12 so that treated areas 18 are adjacent to the tobacco.

In the embodiment illustrated in FIGS. 1 and 2, treated areas 18 are defined as circumferential cross-directional bands 24. Bands 24 are spaced apart from each other longitudinally along the length of cigarette 10. The bands 24 are indicated in phantom in FIG. 2. However, it should be understood that the treated areas are essentially invisible in the formed cigarette as shown in FIG. 1. In other words, a smoker may not discern from any outward sign that the wrapper 14 has been treated in discrete areas 18. In this regard, treated areas 18 have a smooth and flat texture essentially the same as untreated areas 28.

The width and spacing of bands 24 are dependent on a number of variables, such as the initial permeability of wrapper 14, density of tobacco column 12, etc. The bands 24 preferably have a width so that oxygen is limited to the burning coal for a sufficient length or period of time to extinguish the coal. In other words, if band 24 were too narrow, the burning coal would burn through band 24 before self-extinguishing. For most applications, a minimum band width of 3 mm is desired. For example, the band width can be from about 5 mm to about 10 mm.

The spacing between bands 24 is also a factor of a number of variables. The spacing should not be so great that the cigarette burns for a sufficient length of time to ignite a substrate before the coal ever burns into a treated area 18. The spacing between bands 24 also affects the thermal inertia of the burning coal, or the ability of the coal to burn through the treated bands 24 without self-extinguishing. In the cigarettes tested, applicants have found that a band spacing of between 1 and 30 mm is appropriate and particularly between about 10 mm and 25 mm. However, it should be understood that the band spacing can be any suitable width as determined by any number of variables. For most applications, the smoking article can contain from 1 to about 3 bands using the above spacing.

Treated areas 18 have a permeability within a range which is known to provide improved ignition proclivity characteristics for the make-up of cigarette 10. As the coal of cigarette 10 burns into treated areas 18, oxygen available to the burning coal is substantially reduced due to the decreased permeability of wrapper 14 in the treated areas. The reduction of oxygen preferably causes the cigarette to self-extinguish in the treated areas 18 when in contact with a substrate. Applicants have determined that a preferred permeability is less than 20 ml/min/cm$^2$ (CORESTA), particularly less than 12 ml/min/cm$^2$, and generally within a range of 2 to 8 ml/min/cm$^2$. Applicants have found that this range provides the desired self-extinguishing results as the cigarette coal burns into the treated areas.

Besides permeability, another measurement that can be used to indicate reduced ignition proclivity properties is Burn Mode Index. In fact, the Burn Mode Index of a paper wrapper can be more accurate in indicating the burning characteristics of a paper as opposed to simply measuring the permeability of the paper. The test for determining Burn Mode Index is explained in U.S. Pat. No. 4,739,775 to Hampl, which is incorporated herein by reference.

In order to exhibit reduced ignition proclivity properties, the Burn Mode Index ("BMI") of the treated areas 18 can be generally less than about 8 cm$^{-1}$, and particularly from about 1 cm$^{-1}$ to about 5 cm$^{-1}$. For instance, in one embodiment, the burn mode index of the treated areas 18 can be from about 1 cm$^{-1}$ to about 3 cm$^{-1}$.

The composition applied to wrapper 14 in treated areas 18 provides the reduced permeability in the treated areas. Applicants have found that an aqueous or solvent composition that may contain a particulate inorganic non-reactive filler suspended in the composition may be used. Due to the method of application, as described in more detail below, the composition does not cause the paper web to crinkle or pucker when the solvent is dried. This allows for the wrapper 14 to have a smooth and aesthetically pleasing appearance.

Applicants have found that a particularly well suited aqueous composition is one that contains an alginate such as disclosed in U.S. Pat. No. 5,820,998 which is incorporated herein by reference. The aliginate can be, for instance, sodium alginate, potassium alignate, ammonium alginate, propylene glycol alginate, or mixtures thereof.

If the alginate composition is acidic (a pH of less than 7), the composition can cross-link with the filler within the paper and can form a durable surface coating which effectively reduces the paper porosity and reduces the burn rate and ignition propensity of the smoking article. For example, in one embodiment, the alginate composition can contain an acid for adjusting the pH of the composition to from about 3 to about 7. In one embodiment of the present invention, it was discovered that using a weak acid, such as acetic acid is particularly well suited to the process of the present invention. For instance, acetic acid can be added to the composition for adjusting the pH to a range of from about 4 to about 6.5.

In one embodiment, a particulate filler can be added to the composition. In particular, a non-reactive inorganic filler can be used. Applicants have found that a filler may significantly improve the ability of the treated areas 18 to self-extinguish the burning coal. The composition with filler can be more effective in reducing the permeability of the paper web in treated areas 18. Applicants also believe that the composition containing the inorganic filler particles is less affected by the heat of the burning cigarette, thus ensuring that the coating remains intact so as to be effective in restricting oxygen to the burning coal. For example, chalk, clay, calcium carbonate and titanium oxide are particularly well-suited fillers.

The amount of composition that is added to the paper will depend upon various factors, including the type of composition that is used and the desired result. For most applications, especially when using a film-forming composition, the composition can be added to the paper in an amount from about 1% to about 50% by weight of the paper within the banded region, and particularly from about 1% to about 20% by weight of the paper within the banded region after the bands have been formed and dried. Although not always the case, generally the amount of the composition applied to the paper will generally increase as the permeability of the paper increases. For instance, for wrapping papers having a permeability of less than about 30 Coresta units, the composition can be applied to a paper in an amount from about 1% to about 9% by weight. For wrapping papers having a permeability greater than about 60 Coresta units, on the other hand, the composition can be applied to the paper in an amount from about 10% to about 20% by weight.

The present invention pertains to a smoking article wrapper for use with smoking articles, as essentially described above, as well as a method for making the smoking article wrapper. In particular, the present inventors discovered a method for applying a composition to a paper wrapper without causing the paper wrapper to distort or otherwise become adversely affected. In particular, the process of the present invention is directed to applying the composition to the paper wrapper in multiple steps using, for instance, a multi-station printing press.

The inventive method for producing the smoking article wrapper having improved ignition proclivity characteristics includes sequentially applying a composition to a smoking article paper in discrete treated areas 18, such as bands 24 as described above. After each sequential application, the treated areas are dried leaving a film on the paper in treated areas 18. This procedure is repeated a plurality of times so that multiple layers of film are built up and formed on the paper wrapper.

The number of layers of the composition that are applied to the discrete areas of the paper wrapper can vary depending upon the particular circumstances. For instance, from about 2 layers to about 10 layers can be applied to a paper wrapper in accordance with the present invention. For most applications, generally from about 2 layers to about 6 layers will be applied to the paper wrapper, although in some applications, it is believed that 6 to 8 different layers may be preferred.

Figure 3:
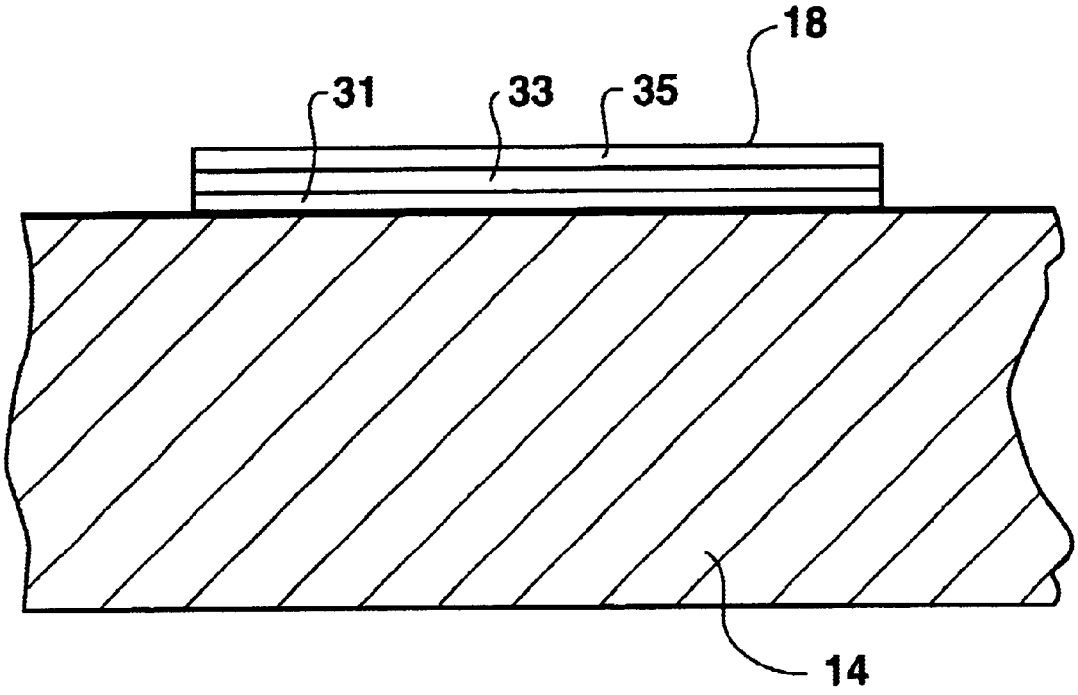
FIG. 3 is a cross-sectional view of a paper wrapper made in accordance with the present invention.

For purposes of illustration, FIG. 3 shows a paper wrapper 14 containing a discrete area 18 made from three different layers. As shown in FIG. 3, layers 31, 33, and 35 are formed on the paper web. First, layer 31 is applied and dried. After layer 31 has dried, layer 33 is applied and dried. Layer 35 is applied and dried last. Each successive layer is printed or applied over each previous layer. The amount of composition that is applied to the paper wrapper 14 during formation of each layer can depend upon various factors including the type of composition being used, the initial permeability of the wrapping paper, the amount of permeability reduction that is needed, and the like. For most applications, however, the composition can be applied to the paper wrapper during each pass in an amount from about 0.25% to about 20% by weight based upon the weight of the wrapper. More particularly, in one embodiment, the composition can be applied to the wrapper in an amount from about 1% to about 15% by weight of the wrapper.

Each layer that is applied to the paper web can be applied at the same rate. In other embodiments, however, the amount of the composition that is applied to the paper wrapper can vary during each sequential step. For example, in one embodiment, a light layer may be first formed on the web and then heavier layers can be applied later. In this embodiment, the light layer can first be applied to the web in order to form a base or foundation for the later heavier layers. In some applications, this method may further prevent the paper wrapper from distorting during formation of the treated areas.

Besides initially forming a light layer followed by heavier layers, in an alternative embodiment of the present invention, it may be desirable to first add greater amounts of the composition to the paper wrapper followed by lighter amounts. In this embodiment, the process may be well suited to fine tuning the amount of composition that is applied to the wrapper. For example, the composition can be applied to the paper wrapper in relatively large amounts to form bands. Lighter layers can then be applied in the treated areas in order to arrive at a particular permeability range or at a particular Burn Mode Index. By applying lighter layers later, it may be possible to better control the resulting properties of the treated areas.

As described above, the amount of composition that is applied during any single application step can depend upon many numerous factors. When applying relatively light layers according to the present invention, however, the composition can be applied to the web in an amount from about 0.25% to about 10% by weight, based upon the weight of the web. Relatively heavier amounts of composition applied to the web, on the other hand, can range from about 1% by weight to about 20% by weight, based upon the weight of the web. When applying the different layers, the amount difference between light layers and heavy layers can be, for instance, greater than 1% by weight add on, particularly greater than 3% by weight add on, and in some applications, greater than 5% by weight add on.

It should be understood that when forming the treated areas on the paper wrapper, light layers and heavy layers can be applied to the wrapper in any desirable order. For instance, light layers can be followed by heavy layers which can then be followed by light layers. The amount applied during each application of the composition can vary. For example, the following is one embodiment of forming a treated area in accordance with the present invention from three layers of a film-forming compositon:

| PASS NUMBER | WT % ADD ON |
|---|---|
| 1 | 2–6% |
| 2 | 10–15% |
| 3 | 12–16% |

The weight % add on included in the above table refers to the total weight of the band after each pass. Thus, as shown above, a relatively light layer is first applied to the wrapper followed by a heavier layer. After the heavier layer, a relatively light layer is then applied.

Figure 4:
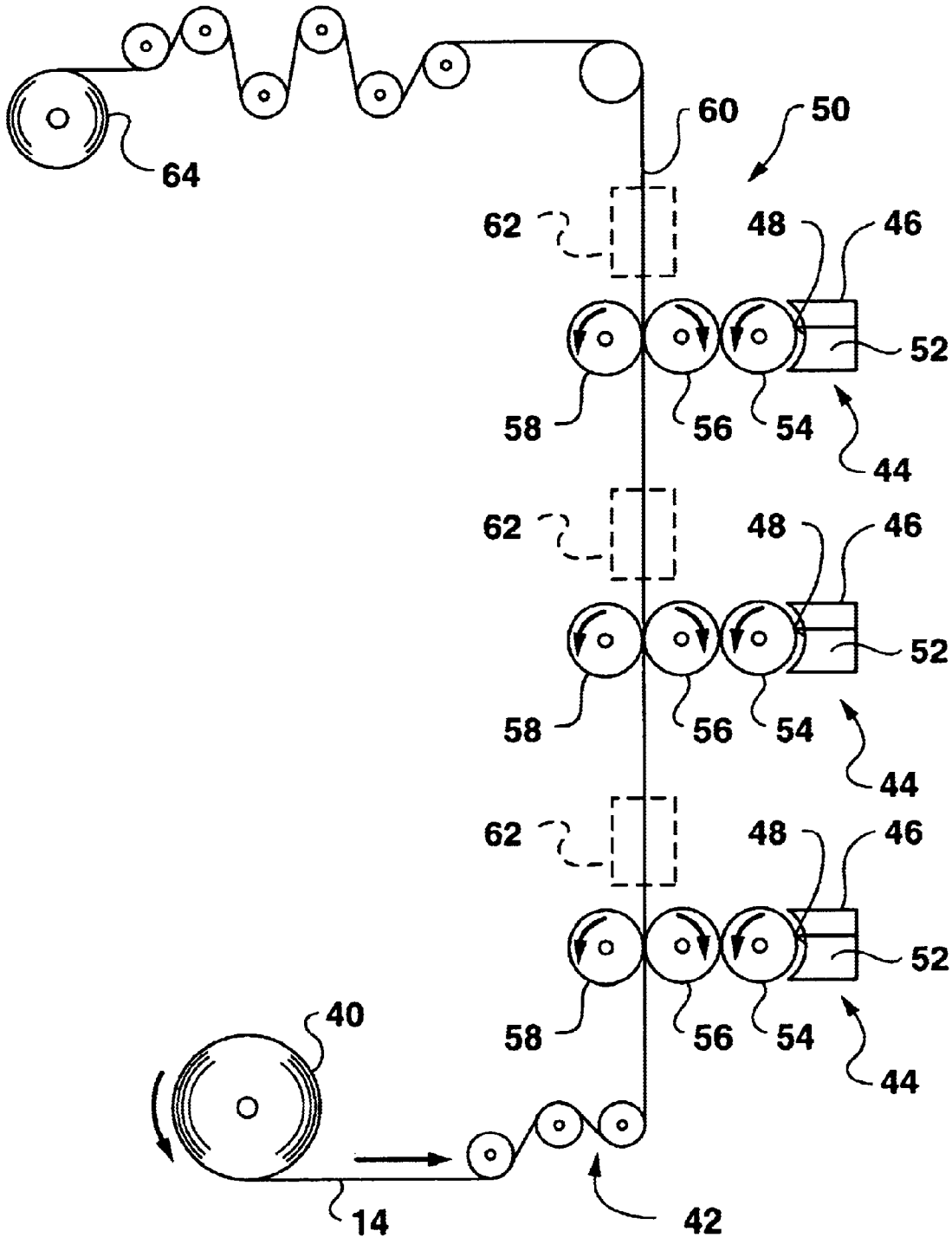
FIG. 4 is a system for treating a paper wrapper in accordance with the present invention.

The manner in which the composition is applied to the paper wrapper can also vary. For example, the composition can be sprayed or printed onto the wrapper. It is believed that printing techniques, however, will provide better control over placement of the composition. In general, any suitable printing process can be used in the present invention. Applicants have found that suitable printing techniques include gravure printing, or flexographic printing. In one embodiment, as illustrated in FIG. 4, a paper layer 14 is unwound from a supply roll 40 and travels in the direction indicated by the arrow associated therewith. Alternatively, the paper layer 14 may be formed by one or more paper-making processes and passed directly into the process 50 without first being stored on a supply roll 40.

As shown in FIG. 4, the paper layer 14 passes through the nip of an S-roll arrangement 42 in a reverse-S path. From the S-roll arrangement 42, the paper layer 14 passes to a gravure printing arrangement 44. The gravure printing process may be a direct print process or an indirect print process, such as by using an offset printer. FIG. 4 depicts an indirect print process. A direct print process may be desirable where large amounts of material (e.g.) are to be applied to the paper layer.

The gravure printing arrangement contains a composition tank 46 and a doctor blade 48 which is used to apply a composition 52 to a gravure roll 54.

The gravure roll 54 may be engraved with a conventional continuous cell pattern (e.g., quadrangular cell pattern) arranged in parallel bands across the width of the roll with nonengraved areas between each band. Each gravure cell holds a small amount of the composition which is released in a pattern onto a rubber applicator roll 56. The paper layer 14 passes through a nip between the rubber applicator roll 56 and a cooperating backup roll 58. The composition is transferred from the applicator roll 56 to the surface of the paper layer 14 thereby forming a coated paper 60. The speeds of the gravure roll 54 and the applicator roll 58 may be controlled so they are the same or so they differ by a minor amount to influence the application of the composition. Once the composition is applied to the paper layer 14, the paper layer can be dried if desired.

For instance, as shown in FIG. 4, after leaving the gravure printing arrangement 44, the paper web 14 is passed through a drying operation 62. During the drying operation 62, the treated paper can be dried using various devices and methods. For example, in one embodiment, the drying operation 62 includes a drying device that passes hot gas such as air over the paper web. The temperature of the air can range from about 100° F. to about 600° F. In an alternative embodiment, the drying device can be a steam can. After being treated with a composition by the gravure printing device, the paper web can be placed in contact with the steam can for drying the composition.

Besides drying the paper with a hot gas stream or with a steam can, in another embodiment of the present invention the paper can be dried by contacting the paper with infra-red rays. For example, in one embodiment, the paper can be passed under a infra-red heating lamp.

In still another alternative embodiment of the present invention, the paper web 14 can be simply air dried during the drying operation 62.

As shown in FIG. 4, the above process for applying and drying a composition on a paper web is then repeated a plurality of times in order to obtain a multi-layered film in accordance with the present invention. In particular, as shown in FIG. 4, the paper layer 14 is passed through a gravure printing arrangement 44 three times and dried three times. Like reference numerals have been used at each gravure printing station to represent like or similar elements. Initially, a relatively small amount of composition is applied and dried. Additional light applications of composition are applied and dried in the same area. These additional applications further reduce the paper porosity by forming a film at the surface.

It should be understood that the process illustrated in FIG. 4 represents merely one embodiment for applying a composition multiple times to the paper wrapper. For instance, a greater or lesser amount of printing stations may be included at any location.

These and other modifications and variations to the present invention may be practiced by those of ordinary skill in the art, without departing from the spirit and scope of the present invention. In addition, it should be understood that aspects of the various embodiments may be interchanged both in whole or in part. Furthermore, those of ordinary skill in the art will appreciate that the foregoing description is by way of example only, and is not intended to limit the invention.

What is claimed:

1. A process for producing a paper wrapper having reduced ignition proclivity characteristics when incorporated into a smoking article comprising the following steps:

providing a paper wrapper comprised of a paper web;

applying multiple layers of a film-forming composition to said paper wrapper at particular locations, said multiple layers of said film-forming composition forming treated discrete areas on said wrapper, said paper wrapper being dried after application of each of said layers, said discrete areas separated by untreated areas, said treated discrete areas having a permeability within a predetermined range sufficient to reduce ignition proclivity, said treated areas reducing ignition proclivity by reducing oxygen to a smoldering coal of the cigarette as the coal burns and advances into said treated areas.

2. The process of claim 1, wherein the multiple layers are printed onto said paper.

3. The process of claim 1, wherein said multiple layers are applied to the paper wrapper using a method selected from the group consisting of flexography, direct gravure printing, and offset gravure printing.

4. The process as in claim 1, wherein said treated areas comprise a plurality of discrete circumferential bands disposed longitudinally along said smoking article.

5. The process as in claim 4, wherein said bands have a width of greater than 4 mm.

6. The process as in claim 4, wherein said bands are spaced from each other at a distance of from about 5 mm to about 30 mm.

7. The process of claim 1, wherein said film-forming composition comprises an alginate.

8. The process of claim 1, wherein said film-forming composition comprises a pectin.

9. The process of claim 1, wherein said film-forming composition comprises a silicate.

10. The process of claim 1, wherein said film-forming composition comprises a polyvinyl alcohol.

11. The process of claim 1, wherein the film-forming composition comprises a starch.

12. The process of claim 1, wherein the film-forming composition comprises a cellulose derivative.

13. The process of claim 1, wherein the paper wrapper has a permeability of from about 60 Coresta to about 90 Coresta prior to applying said film-forming composition.

14. The process of claim 13, wherein said paper wrapper has a permeability of less than about 20 Coresta within the treated discrete areas.

15. The process of claim 1, wherein the treated discrete areas have a BMI of from about 1 $cm^{-1}$ to about 8 $cm^{-1}$.

16. The process of claim 1, wherein the film-forming composition is applied to the paper wrapper in the treated discrete areas in an amount up to about 50% by weight based upon the weight of the paper wrapper.

17. The process of claim 1, wherein the amount of the film-forming composition that is applied to the paper wrapper varies between at least two of the layers.

18. The process of claim 1, wherein the paper wrapper is dried between application of each of the layers by being contacted with a hot gas.

19. A process for producing a smoking article comprising the step of surrounding a tobacco column with the paper wrapper defined in claim 1.

20. The process of claim 1, wherein the paper wrapper is dried between application of each of the layers by being contacted with infra-red rays.

21. A process for producing a paper wrapper having reduced ignition proclivity characteristics when incorporated into a smoking article comprising the following steps:

providing a paper wrapper comprised of a paper web;

applying multiple layers of a film-forming composition to said paper wrapper at particular locations, said multiple layers including at least a first layer and a second layer, the second layer being positioned on top of said first layer, the first layer containing said composition in a first amount in a weight per area basis, said second layer containing said composition in a second amount In a weight per area basis, said first amount being less than said second amount, said multiple layers of said film-forming composition forming treated discrete areas on said wrapper, said discrete areas separated by untreated areas, said treated discrete areas having a permeability within a predetermined range sufficient to reduce ignition proclivity, said treated areas reducing ignition proclivity by reducing oxygen to a smoldering coal of the cigarette as the coal burns and advances into said treated areas.

22. The process of claim 21, wherein the film-forming composition is applied to the paper wrapper to form the first layer in an amount up to about 10% by weight based upon the weight of the wrapper and wherein the film-forming composition is applied to the paper wrapper to form the second layer in an amount from about 1% to about 20% by weight based upon the weight of the wrapper.

23. The process of claim 21, further comprising the step of drying the paper wrapper after application of each of the layers of the film-forming composition.

24. The process of claim 21, wherein the multiple layers are printed onto said paper wrapper.

25. The process of claim 21, wherein said multiple layers are applied to the paper wrapper using a method selected from the group consisting of flexography, direct gravure printing, and offset gravure printing.

26. The process as in claim 21, wherein said treated areas comprise a plurality of discrete circumferential bands disposed longitudinally along said smoking article.

27. The process as in claim 26, wherein said bands are spaced from each other at a distance of from about 5 mm to about 30 mm.

28. The process of claim 21, wherein said film-forming composition comprises an alginate composition.

29. The process of claim 21, wherein said film-forming composition comprises a pectin composition.

30. The process of claim 21, wherein said film-forming composition comprises a silicate composition.

31. The process of claim 21, wherein said film-forming composition comprises a polyvinyl alcohol composition.

32. The process of claim 21, wherein the treated discrete areas have a BMI of from about 1 $cm^{-1}$ to about 5 $cm^{-1}$.

33. A process for producing a smoking article comprising the step of surrounding a tobacco column with the paper wrapper defined in claim 21.

34. The process of claim 21, wherein the film-forming composition comprises a starch composition.

35. The process of claim 21, wherein the film-forming composition comprises a cellulose derivative composition.

36. A process for producing a paper wrapper having reduced ignition proclivity characteristics when incorporated into a smoking article comprising the following steps:

providing a paper wrapper comprised of a paper web, said paper web having a relatively high permeability, the permeability of the paper web being from about 60 Coresta to about 110 Coresta;

applying a film-forming composition, to said paper wrapper at particular locations, said film-forming composition forming treated discrete areas on said wrapper, said discrete areas separated by untreated areas, said treated discrete areas having a permeability within a predetermined range sufficient to reduce ignition proclivity, said permeability being less than about 20 Coresta within the treated areas, said treated areas having a Burn Mode Index of less than about 8 $cm^{-1}$, said treated areas reducing ignition proclivity by reducing oxygen to a smoldering coal of the cigarette as the coal burns and advances into said treated areas.

37. The process of claim 36, wherein the film-forming composition is applied in multiple layers to form the treated discrete areas.

38. The process of claim 37, further comprising the step of drying the paper wrapper in between application of each of the multiple layers of the film-forming composition.

39. The process of claim 36, wherein the film-forming composition is printed onto the paper wrapper.

40. The process of claim 36, wherein the film-forming composition is applied to the paper wrapper using a method selected from the group consisting of flexography, direct gravure printing, and offset gravure printing.

41. The process of claim 36, wherein said treated areas comprise a plurality of discrete circumferential bands disposed longitudinally along said smoking article.

42. The process of claim 36, wherein said film-forming composition comprises an alginate composition.

43. The process of claim 36, wherein said film-forming composition comprises a pectin composition, a silicate composition, a polyvinyl alcohol composition, a starch composition, or a cellulose derivative composition.

44. The process of claim 36, wherein the paper web has a permeability of greater than about 80 Coresta and wherein the treated discrete areas have a permeability of less than about 6 Coresta.

45. A process for producing a smoking article comprising the step of surrounding a tobacco column with the paper wrapper defined in claim 36.

46. A process for producing a paper wrapper having reduced ignition proclivity characteristics when incorporated into a smoking article comprising the following steps:

providing a paper wrapper comprised of a paper web;

applying multiple layers of a film-forming composition to said paper wrapper at particular locations, said multiple layers including at least a first layer and a second layer, the second layer being positioned on top of said first layer, the first layer containing said composition in a first amount in a weight per area basis, said second layer containing said composition in a second amount in a weight per area basis, said first amount being selectively greater than or less than the second amount, said multiple layers of said film-forming composition forming treated discrete areas on said wrapper, said discrete areas separated by untreated areas, said treated discrete areas having a permeability within a predetermined range sufficient to reduce ignition proclivity, said treated areas reducing ignition proclivity by reducing oxygen to a smoldering coal of the cigarette as the coal burns and advances into said treated areas, wherein the paper wrapper has a permeability of from about 60 Coresta to about 90 Coresta prior to applying the film-forming composition.

* * * * *

US006725867C1

(12) INTER PARTES REEXAMINATION CERTIFICATE (1167th)

United States Patent

Peterson et al.

(10) Number: US 6,725,867 C1

(45) Certificate Issued: Sep. 18, 2015

(54) PROCESS FOR PRODUCING SMOKING ARTICLES WITH REDUCED IGNITION PROCLIVITY CHARACTERISTICS AND PRODUCTS MADE ACCORDING TO SAME

(75) Inventors: Richard M. Peterson, Marietta, GA (US); Joseph S. Kucherovsky, Philadelphia, PA (US); Thomas A. Kraker, Alpharetta, GA (US)

(73) Assignee: SCHWEITZER-MAUDUIT INTERNATIONAL, INC., Alpharetta, GA (US)

Reexamination Request:
No. 95/001,493, Nov. 24, 2010

Reexamination Certificate for:

| | |
|---|---|
| Patent No.: | **6,725,867** |
| Issued: | **Apr. 27, 2004** |
| Appl. No.: | **10/054,744** |
| Filed: | **Nov. 13, 2001** |

Related U.S. Application Data

(60) Provisional application No. 60/248,061, filed on Nov. 13, 2000.

(51) Int. Cl.

| | |
|---|---|
| ***A24D 1/02*** | (2006.01) |
| ***A24D 1/16*** | (2006.01) |
| ***D21H 27/00*** | (2006.01) |

(52) U.S. Cl.
CPC *A24D 1/02* (2013.01); *A24D 1/025* (2013.01); *D21H 5/16* (2013.01)

(58) Field of Classification Search
USPC ..... 131/365
See application file for complete search history.

(56) References Cited

To view the complete listing of prior art documents cited during the proceeding for Reexamination Control Number 95/001,493, please refer to the USPTO's public Patent Application Information Retrieval (PAIR) system under the Display References tab.

*Primary Examiner* — Carlos Lopez

(57) ABSTRACT

A process for reducing the permeability of a paper wrapper used in the construction of a smoking article is disclosed. The paper wrapper is treated with a film-forming composition that forms treated discrete areas on the wrapper. The treated discrete areas have a permeability within a predetermined range sufficient to reduce the ignition proclivity properties of a smoking article made with the wrapper. In accordance with the present invention, the film-forming composition is applied as multiple layers to the paper wrapper. After each application step, the wrapper is dried. Applying the film-forming composition to the paper wrapper in multiple layers minimizes distortion and other adverse affects that may occur to the wrapper.

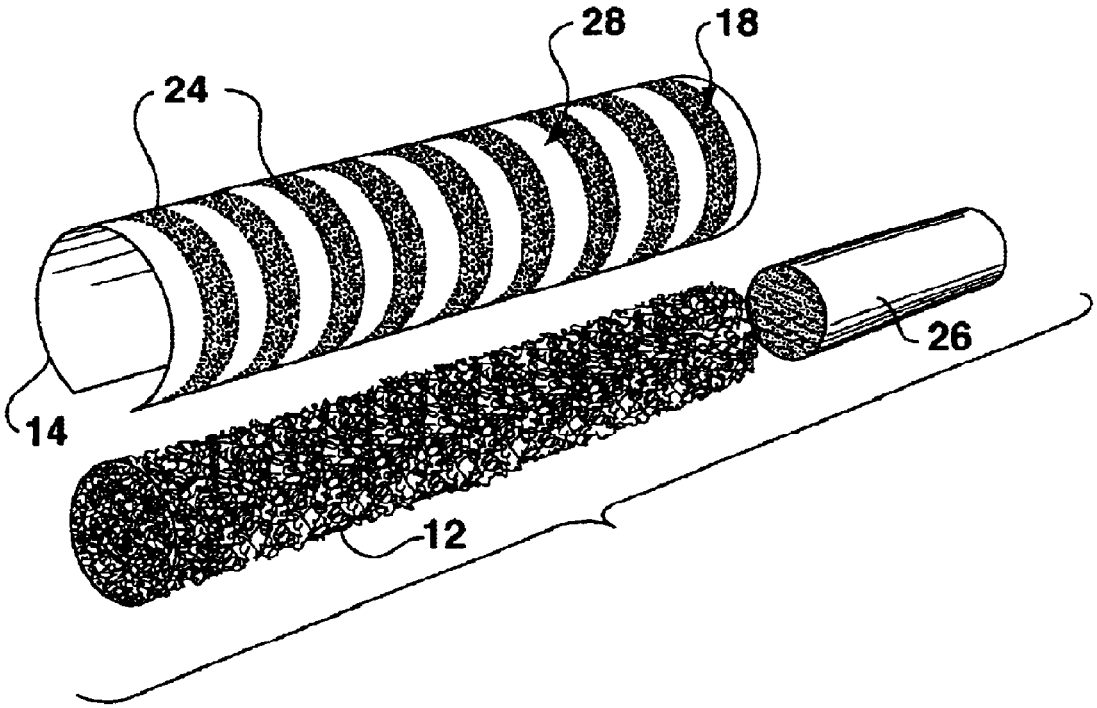

INTER PARTES REEXAMINATION CERTIFICATE

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 15, 17, 21-35, 37, 38, 41, 42 and 46 is confirmed.

Claims 1-14, 16, 18-20, 36, 39, 40 and 43-45 are cancelled.

New claims 47-105 are added and determined to be patentable.

*47. The process of claim 36, wherein the treated areas comprise a plurality of discrete bands disposed along the paper wrapper, the bands having a width of greater than about 4 mm.*

*48. The process of claim 36, wherein the treated areas comprise a plurality of discrete bands disposed along the paper wrapper, the bands having a width of from about 5 mm to about 10 mm.*

*49. The process of claim 36, wherein the treated areas comprise a plurality of discrete bands disposed along the paper wrapper, the bands being spaced from each other a distance of from about 10 mm to about 25 mm.*

*50. The process of claim 36, wherein the treated areas comprise a plurality of discrete bands disposed along the paper wrapper, the bands having a width of greater than about 4 mm, and wherein the bands are spaced from each other a distance of from about 10 mm to about 25 mm.*

*51. The process of claim 36, wherein the treated areas comprise a plurality of discrete bands disposed along the paper wrapper, the bands having a width of from about 5 mm to about 10 mm, and wherein the bands are spaced from each other a distance of from about 10 mm to about 25 mm.*

*52. The process of claim 36, wherein the treated areas comprise a plurality of discrete bands disposed along the paper wrapper, the paper wrapper including up to three bands.*

*53. The process of claim 36, wherein the treated areas comprise a plurality of discrete bands disposed along the paper wrapper, the bands having a width of greater than about 4 mm, and wherein the paper wrapper contains up to three bands.*

*54. The process of claim 36, wherein the treated areas comprise a plurality of discrete bands disposed along the paper wrapper, the bands having a width of from about 5 mm to about 10 mm, and wherein the paper wrapper includes up to three bands.*

*55. The process of claim 36, wherein the treated areas comprise a plurality of discrete bands disposed along the paper wrapper, the bands being spaced from each other a distance of from about 10 mm to about 25 mm, and wherein the paper wrapper includes up to three bands.*

*56. The process of claim 36, wherein the treated areas comprise a plurality of discrete bands disposed along the paper wrapper, the bands having a width of greater than about 4 mm, and wherein the film-forming composition comprises a starch.*

*57. The process of claim 36, wherein the treated areas comprise a plurality of discrete bands disposed along the paper wrapper, the bands having a width of greater than about 4 mm, and wherein the film-forming composition comprises an alginate.*

*58. The process of claim 36, wherein the treated areas comprise a plurality of discrete bands disposed along the paper wrapper, the bands having a width of greater than about 4 mm, and wherein the film-forming composition comprises a cellulose derivative.*

*59. The process of claim 36, wherein the film-forming composition comprises a starch.*

*60. The process of claim 50, wherein the film-forming composition comprises a starch.*

*61. The process of claim 50, wherein the film-forming composition comprises an alginate.*

*62. The process of claim 50, wherein the film-forming composition comprises a cellulose derivative.*

*63. The process of claim 36, wherein the film-forming composition further contains a filler.*

*64. The process of claim 56, wherein the film-forming composition further contains a filler.*

*65. The process of claim 57, wherein the film-forming composition further contains a filler.*

*66. The process of claim 58, wherein the film-forming composition further contains a filler.*

*67. The process of claim 36, wherein the paper web has a permeability of from about 60 Coresta to about 90 Coresta.*

*68. The process of claim 50, wherein the paper web has a permeability of from about 60 Coresta to about 90 Coresta.*

*69. The process of claim 56, wherein the paper web has a permeability of from about 60 Coresta to about 90 Coresta.*

*70. The process of claim 57, wherein the paper web has a permeability of from about 60 Coresta to about 90 Coresta.*

*71. The process of claim 58, wherein the paper web has a permeability of from about 60 Coresta to about 90 Coresta.*

*72. The process of claim 36, wherein the treated areas have a Burn Mode Index of less than about 5 $cm^{-1}$.*

*73. The process of claim 36, wherein the treated areas have a Burn Mode Index of less than about 3 $cm^{-1}$.*

*74. The process of claim 47, wherein the treated areas have a Burn Mode Index of less than about 5 $cm^{-1}$.*

*75. The process of claim 47, wherein the treated areas have a Burn Mode Index of less than about 3 $cm^{-1}$.*

*76. The process of claim 50, wherein the treated areas have a Burn Mode Index of less than about 5 $cm^{-1}$.*

*77. The process of claim 50, wherein the treated areas have a Burn Mode Index of less than about 3 $cm^{-1}$.*

*78. The process of claim 51, wherein the treated areas have a Burn Mode Index of less than about 5 $cm^{-1}$.*

*79. The process of clam 51, wherein the treated areas have a Burn Mode Index of less than about 3 $cm^{-1}$.*

*80. The process of claim 36, wherein the treated areas have a permeability of less than 20 Coresta.*

*81. A process for producing a paper wrapper having reduced ignition proclivity characteristics when incorporated into a cigarette comprising the following steps: providing a paper wrapper comprised of a paper web, said paper web having a permeability of from about 60 Coresta to about 110 Coresta; applying a film-forming composition to said paper wrapper at particular locations, said film-forming composition forming treated discrete areas on said wrapper, said discrete areas separated by untreated areas, said treated discrete areas having a permeability of less than about 20 Coresta within the treated areas, said treated areas having a Burn Mode Index of less than about 5 $cm^{-1}$, said treated areas reducing ignition proclivity by reducing oxygen to a smolder-*

*ing coal of a cigarette as the coal burns and advances into said treated areas, and wherein the treated areas comprise a plurality of discrete bands disposed along the paper wrapper, the bands having a width of from about 4 mm to about 10 mm and being spaced from each other a distance of from about 5 mm to about 20 mm.*

*82. The process of claim 81, wherein the paper web has a permeability of from about 60 Coresta to about 90 Coresta.*

*83. The process of claim 81, wherein the film-forming composition comprises an alginate.*

*84. The process of claim 81, wherein the film-forming composition comprises a starch.*

*85. The process of claim 81, wherein the film-forming composition contains a filler.*

*86. The process of claim 82, wherein the film-forming composition comprises an alginate.*

*87. The process of claim 82, wherein the film-forming composition comprises a starch.*

*88. The process of claim 82, wherein the film-forming composition contains a filler.*

*89. The process of claim 81, wherein the film-forming composition comprises an alginate and a filler.*

*90. The process of claim 81, wherein the film-forming composition comprises a starch and a filler.*

*91. A process for producing a paper wrapper having reduced ignition proclivity characteristics when incorporated into a cigarette comprising the following steps: providing a paper wrapper comprised of a paper web; said paper web having a permeability of from about 60 Coresta to about 110 Coresta; applying multiple layers of a film-forming composition to said paper wrapper at particular locations, said multiple layers of said film-forming composition forming treated discrete areas on said wrapper, said paper wrapper being dried after application of each of said layers, said treated discrete areas being separated by untreated areas, said treated discrete areas having a permeability of less than about 20 Coresta within the treated areas, said treated areas having a Burn Mode Index of less than about 8 $cm^{-1}$, said treated areas reducing ignition proclivity by reducing oxygen to a smoldering coal of a cigarette as the coal burns and advances into said treated areas.*

*92. The process of claim 91, wherein the multiple layers are printed onto said paper.*

*93. The process of claim 91, wherein said multiple layers are applied to the paper wrapper using a method selected from the group consisting of flexography, direct gravure printing, and offset gravure printing.*

*94. The process as in claim 91, wherein said treated areas comprise a plurality of discrete circumferential bands disposed longitudinally along said paper wrapper.*

*95. The process of claim 91, wherein said film-forming composition comprises an alginate.*

*96. The process of claim 91, wherein said film-forming composition comprises a starch.*

*97. The process of claim 91, wherein said film-forming composition comprises a pectin, a polyvinyl alcohol, or a cellulose derivative.*

*98. The process of claim 91, wherein the paper wrapper has a permeability of from about 60 Coresta to about 90 Coresta prior to applying said film-forming composition.*

*99. The process of claim 91, wherein the treated discrete areas have a BMI of less than about 5 $cm^{-1}$.*

*100. The process of claim 91, wherein the film-forming composition is applied to the paper wrapper in the treated discrete areas in an amount up to about 50% by weight based upon the weight of the paper wrapper.*

*101. The process of claim 91, wherein the amount of the film-forming composition that is applied to the paper wrapper varies between at least two of the layers.*

*102. The process of claim 91, wherein the paper wrapper is dried between application of each of the layers by being contacted with a hot gas.*

*103. A process for producing a cigarette comprising the step of surrounding a tobacco column with the paper wrapper defined in claim 91.*

*104. The process of claim 91, wherein the paper wrapper is dried between application of each of the layers by being contacted with infra-red rays.*

*105. The process of claim 91, wherein the paper web has a permeability of from about 60 Coresta to about 90 Coresta.*

* * * * *